US011151841B2

(12) United States Patent
Donelan et al.

(10) Patent No.: US 11,151,841 B2
(45) **Date of Patent: *Oct. 19, 2021**

(54) SYSTEM, METHOD, AND DEVICE FOR PROVIDING A GAME AWARDING PRIZES ACCORDING TO LOCATIONS OF WINNING RELOCATABLE GAMING INDICIA

(71) Applicant: Deck of Dice Gaming, Inc., Strongsville, OH (US)

(72) Inventors: Thomas J. Donelan, Strongsville, OH (US); Mark C. Nicely, Daly City, CA (US); Steve Cartwright, Strongsville, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/814,819

(22) Filed: Mar. 10, 2020

(65) Prior Publication Data

US 2020/0211330 A1 Jul. 2, 2020

Related U.S. Application Data

(63) Continuation of application No. 15/279,283, filed on Sep. 28, 2016, now Pat. No. 10,586,426.

(60) Provisional application No. 62/233,978, filed on Sep. 28, 2015.

(51) Int. Cl.
*G07F 17/32* (2006.01)

(52) U.S. Cl.
CPC ..... *G07F 17/3246* (2013.01); *G07F 17/3206* (2013.01); *G07F 17/3211* (2013.01); *G07F 17/3251* (2013.01); *G07F 17/3267* (2013.01); *G07F 17/3293* (2013.01)

(58) Field of Classification Search
USPC ..... 463/11, 12, 13
See application file for complete search history.

(56) References Cited

U.S. PATENT DOCUMENTS

| | | | | |
|---|---|---|---|---|
| 7,704,141 | B1 * | 4/2010 | Marks | G07F 17/34 463/20 |
| 2017/0087443 | A1 * | 3/2017 | Milosevich | A63F 3/00157 |
| 2017/0312618 | A1 * | 11/2017 | Milosevich | G07F 17/32 |
| 2019/0066440 | A1 * | 2/2019 | Lamond | G07F 17/3216 |
| 2019/0295377 | A1 * | 9/2019 | Suda | G07F 17/3267 |
| 2019/0347899 | A1 * | 11/2019 | Lamond | G07F 17/3293 |
| 2020/0160662 | A1 * | 5/2020 | Cong | G07F 17/3213 |

* cited by examiner

*Primary Examiner* — Pierre E Elisca
(74) *Attorney, Agent, or Firm* — Newman Law, LLC

(57) ABSTRACT

A gaming machine, system, and method for presenting a game may include accepting a wager, randomly selecting k relocatable indicia from a set of N possible indicia, where N>k, positioning the k indicia into j possible locations (j>=k), evaluating the k indicia relative to first paytable with payout rules based solely on the indicia values, evaluating the k indicia relative to a second paytable with payout rules based on at least the location of the indicia, and awarding any prizes earned.

20 Claims, 11 Drawing Sheets

SYSTEM, METHOD, AND DEVICE FOR PROVIDING A GAME AWARDING PRIZES ACCORDING TO LOCATIONS OF WINNING RELOCATABLE GAMING INDICIA

CROSS REFERENCE TO RELATED APPLICATION

This application claims priority to U.S. Provisional Application No. 62/233,978 which was filed on Sep. 28, 2015, the contents of which are hereby incorporated by reference.

BACKGROUND

1. Field

The disclosed embodiments relate to gaming systems and devices. More particularly, the disclosed embodiments relate to a method, system, and device where a plurality of gaming element indicia are randomly selected and positioned before being evaluated for payouts via a first set of rules based on the type of indicia and on a second set of rules based on position.

2. Related Art

There are known games involving the random selection of a plurality of gaming elements that are evaluated based on a first set of game rules based only on the type or value of the indicia, such as the selection of five cards from a deck of playing cards in Video Poker games or such as the rolling of five dice in poker dice games.

In some of these games, often referred to as "stud" games, the final gambling result is based entirely on the initial indicia selection. In other such games, often referred to as "draw" games, one or more of the indicia may be changed based on game rules or player selection prior to evaluation of the final gambling result.

In some implementations, such as with physical dice or with digitally generated dice meant to visually emulate physical dice, the positioning of the indicia can be in any location within a common defined area within the game field.

In other implementations selected indicia are positioned at specific locations such as each of the 5 cards visible in Video Poker always being positioned in the same location on the game field, but the actual ordering of the cards is not considered for the purposes of gambling evaluation.

In other implementation, such as Video Poker variations where a subset of the defined awards (usually a Royal Flush dealt in rank-ascending order and/or in rank-descending order), the order of the indicia may or may not matter based on the outcome.

Other implementations, such as the Power Dice game that evaluates dice arranged in a grid based on indicia value and position, comparable to slot machine games that evaluate slot reel symbols based on the appearance of each symbol and its location relative to other symbols with respect to positional patterns often referred to as paylines or pay lines, the positioning of the indicia is fundamental to the gambling evaluation. However, card and dice differ from slot games insofar as slot machines involve gaming elements constrained to specific locations, especially in terms of horizontal placement viz. a viz. different reel strips assigned to different columns whereas dice and cards are freely positionable.

Some of these games include gaming elements that present a plurality of components per indicia, such as a suit designator and a rank designator that appear on most playing cards and certain types of dice. In such games, award definitions can be based on either or both types of indicia components, such as the following example traditional poker ranks:

TABLE 1

| |
|---|
| Royal Flush (suit and rank) |
| Straight Flush (suit and rank) |
| Four-of-a-Kind (rank) |
| Full House (rank) |
| Flush (suit) |
| Straight (rank) |
| Two Pair (rank) |
| Pair (rank) |

Other of these games include gaming elements that present only a single component per indicia, such as the number of spots or pips visible on the top-most side of a rolled or thrown die. In such games, award definitions are based solely on the single type of indicia component, such as shown in the following poker-dice ranks:

TABLE 2

| | |
|---|---|
| Five-of-a-Kind | All five dice display same value |
| Four-of-a-Kind | Four of the five dice display the same value and one other die displays a different value |
| Full House | Three dice display the same first value and two other dice display the same second value |
| Three-of-a-Kind | Three dice display the same first value and two other dice display each a value that does not match any other visible value |
| Two Pair | Two dice display the same first value and two other dice display the same second value and one other die displays a value that does not match any other visible value |
| Pair | Two dice display the same value and three other dice display each a value that does not match any other visible value |

There are also known games whereby the evaluation of the gambling outcome is based solely on the positioning of one or more game elements relative to one or more other game elements, such as which marked roulette wheel well a roulette ball lands in roulette, or such as which wheel slice on a rotating aligns with one or more wheel pointers or flippers in the Money Wheel game or in Wheel of Fortune slot game bonus.

There continues to be a need for devices and methods of conducting and playing new and exciting wagering and casual games.

SUMMARY

Accordingly, the disclosed embodiments provide a method, gaming device, and gaming system where a plurality gaming element indicia are randomly selected and positioned before being evaluated for payouts via a first set of rules based on the type indicia and a second set of rules based on position.

In one embodiment, there is a method and system of conducting a wagering game on a gaming machine. The gaming machine may comprise a monetary-funds accepting mechanism for accepting monetary funds to increase a player credit balance, at least one display device, at least one player input device, a memory device, and a controller. The method may include receiving monetary funds from a player to increase a credit balance at the gaming machine, and receiving a wager from the credit balance from the player via the at least one player input device.

The display of the gaming machine is then configured to display a virtual playing surface which may have at least one designatable game piece position marker. A plurality of relocatable playing pieces are provided and displayed. At least one of the relocatable playing pieces is randomly selected and positioned into a predefined position to form a playing hand. A first evaluation of the playing hand is conducted to determine whether the playing hand comprises a winning outcome A second evaluation of the playing hand may be conducted to determine whether any of the relocatable playing pieces forming the playing hand that are part of the winning outcome are disposed on a position of the predefined arrangement marked by the at least one designatable game piece position marker. Prizes are awarded based on the first and the second evaluation.

In some embodiments, the relocatable gaming pieces are dice. For example, the dice may be six-sided dice with pips. The dice may also include a set of non-identically indiciaed dice. In other examples, the relocatable gaming pieces are playing cards.

The first evaluation may include comparing the playing hand to a first payout table based on poker outcomes. For example, the winning outcome may include a poker outcome such as a straight, a full house, etc. The awarded prize may include a bonus event such as at least one free game.

In some embodiments, one second award is based on the second evaluation and provides for an increase in the value of a first award based on the first evaluation. The increase in the value of the first award may be a multiplication of the value of the first award. The multiplication may be based on a fixed value or a variable value. The value may be displayed as part of the designatable positioning marker on the playing surface. In some instances, the variable value is based on a secondary determination. The secondary determination may include a random selection from a weighted table of available values, an outcome represented by a virtual throwing or virtual rolling of at least one die, by a draw of a card, or by some other game action.

In one example embodiment, the predefined arrangement comprises a grid, and the at least one designatable game piece position markers designate a predetermined pattern of positions on the grid. In some instances, a first wager activates the first evaluation and a second wager activates the second evaluation.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF EMBODIMENTS

Figure 1:
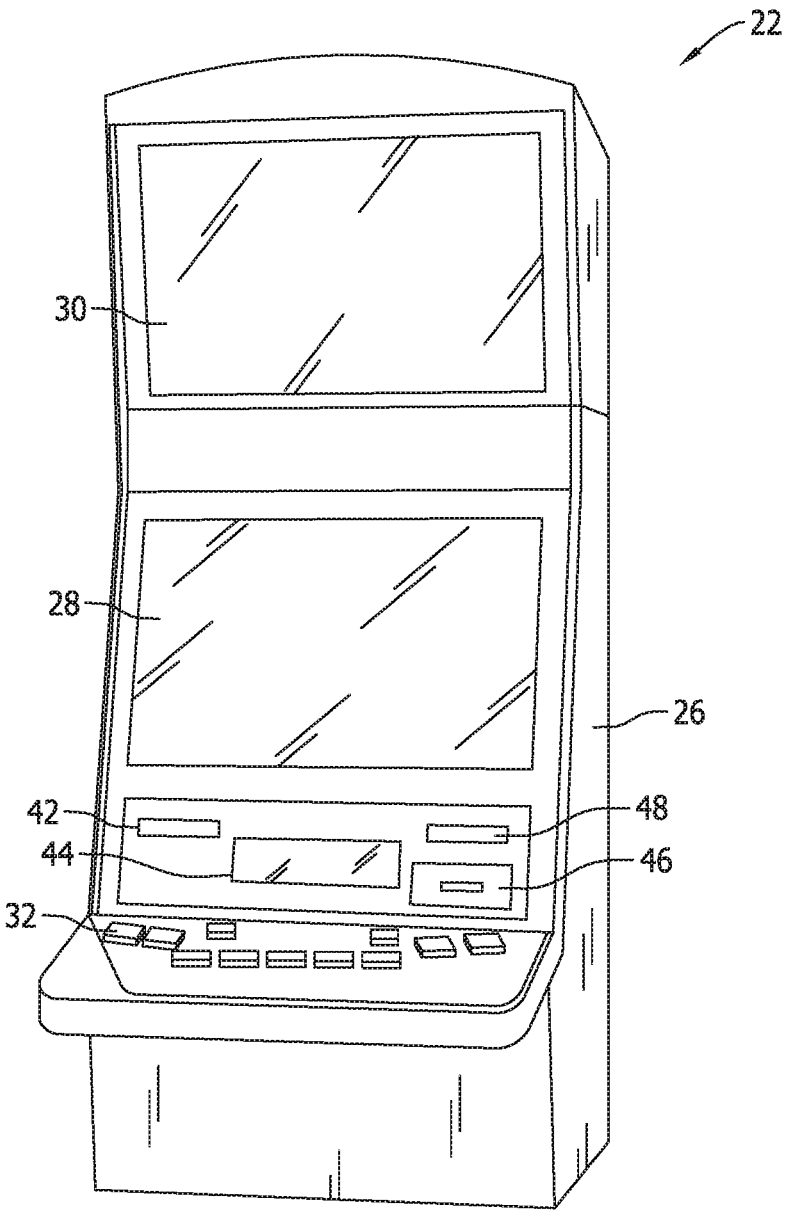
FIG. 1 shows a gaming machine, according to one exemplary embodiment.

One series of embodiments provides a Poker Dice-style wagering game where dice outcomes are randomly determined and the dice are positioned into one of a plurality of available positions by a mechanism such as random placement, physics-based placement, ordered placement relative to explicit game rules, placement controlled by non-explicit game implementation, or any other suitable mechanism.

Some of the positions onto which dice are positioned are designated as belonging to a first set of bonus positions, belonging to a second set of bonus positions, or not belonging to any set of bonus positions. Such bonus location(s) may be designated randomly before the start of each game, designated randomly after the end of each game, designated in a predetermined manner which applies to multiple games, designated by the player before the start of each game, designated by the player before the start of a series of games, or designated by any other suitable mechanism.

Once all dice are positioned, the values on the top surface of the dice, or a visible surface of digital dice, are evaluated relative to a first paytable based on defined outcomes, such as poker outcomes. The dice are also evaluated based on a second paytable according to other criteria, at least one of which is position. In one embodiment, it may be that the dice values can be interpreted to match two or more of the defined winning outcomes. Accordingly, the outcome with the highest payout may be selected. In other embodiments, the outcome with the lowest payout may be selected, or one of the matched defined winning outcomes may be chosen randomly. If the game outcome is evaluated as a winning outcome relative to a first paytable, the player receives a first award. If the game outcome is evaluated as a winning outcome relative to a second paytable, the player receives a second award. In some variations, the type or value of the second paytable award is dependent upon the type or value of the first paytable outcome. In other variations, the type or value of the second paytable award is not dependent upon the type or value of the first paytable outcome.

In some embodiments, the second paytable evaluation criteria is dependent upon a primary paytable evaluation. For example, a secondary paytable requires that a certain number of winning dice be positioned at or on locations belonging to a specific set of bonus positions, where "winning dice" refers to the specific dice designated by a first paytable evaluation. In some variations, winning dice are a minimum set of dice required to form the highest poker hand of the highest-paying first paytable outcome. In some other variations, winning dice are a minimum set of dice required to form any hand of the highest-paying first paytable outcome type. In some other variations, winning dice are minimum set of dice required to form any hand which activates the bonus, even if a higher-paying hand also exists.

For example, a game outcome comprised of these six game indicia: 3♥, 5♥, 7♥, 9♥, J♥, and A♥, would successfully match a five-indicia "Flush" outcome in a poker-based paytable. To form the highest-ranking flush, one would choose the five highest-ranking indicia and ignore the lowest-ranking indicia which is the 3-of-hearts. However, there are six ways to form a five-indicia flush: one for each indicium selected as the ignored indicium.

In other embodiments, the second paytable evaluation criteria includes an indicia value matching criteria which is different from the first paytable indicia value matching criteria. This would include, for example, a second paytable indicia value criteria that is based on the sum of values of the indicia positioned on or at locations belonging to a specific set of bonus positions or would include a second paytable indicia value criteria that is based the color matching of the suits of the indicia positioned on or at locations belonging to a specific set of bonus positions.

In some embodiments, each of N locations belonging to a specific set of bonus positions requires a winning die. In some other embodiments, k of N locations belonging to a specific set of bonus positions or requires a winning die, where k<N. In some embodiments, there is a single bonus position. In some embodiments, there is a list comprised of at least two selections, wherein each the selection designates a single bonus positions. In some other embodiments, there is a single designation of two or more bonus positions. In some embodiments, there is a list with at least two selections, wherein each the selection designates a set of one or more bonus positions. In some multi-selection variations, no two designated bonus positions or sets of designated bonus positions share the same position. In some other multi-selection variations, two or more designated bonus positions or sets of designated bonus positions share one or more common positions. In some multi-selection variations, each selection designates the same number of bonus positions. In some other multi-set variations, a first selection has a different number of designated bonus positions as a second selection. In some multi-selection variations, each selection of designated bonus positions provides the same awards. In some other multi-selection variations, the designated bonus position(s) from a first selection pays different awards than the designated bonus position(s) from a second selection.

In some embodiments, the awards from a first paytable evaluation are of a different type than the awards from a second paytable evaluation. In some embodiments, the value of a second paytable award is dependent upon a first paytable evaluation such as in a game, for example, where a second paytable award multiplies the value of the primary paytable award. An award event can be of any suitable type including but not limited to a fixed award amount, a variable award amount, a progressive jackpot award amount, a primary currency award, a secondary currency award, a loyalty program award, a player status level award, the triggering of a bonus game or event, the advancement of bonus triggering progress bar, or any other suitable prize or prize event.

In embodiments in which a bonus event is awarded, the bonus event can be of any suitable type including but not limited to free games with the same paytable, free games with one or more alternate paytables, one or more draw rounds where certain dice are held and other dice re-rolled based on system selection, draw rounds where certain dice are held and other dice re-rolled based on player selection, a bonus game based on a different mechanism than that of the base game, or any suitable bonus event or combination thereof.

In some variations, the same type of bonus event is awarded. In some other variations, different types of bonus events are awarded. In some variations, the extent of the awarded bonus, such as the number of awarded free games, or the number of draw rounds, or any other specific quantity is the same for all bonus events awarded. In some variations, the extent of the awarded bonus can vary from award to award. In variations with variable type of bonus award and/or variable bonus award extent, the variation can be based on any suitable factor including but not limited to: a first paytable evaluation; a second paytable evaluation; player selection of hidden values; player selection of visible values; a secondary determination mechanism not displayed to the player; a secondary determination mechanism such as the spin of a wheel, roll of dice, opening of a prize chest, a drawing of a card or any other kind of suitable mechanism that is displayed to the player; player loyalty program status; player's most recent wager size; player wager history; community game play outcome or event; or any other suitable mechanism or combination thereof.

Another series of embodiments of the present invention provides variations of Video Poker wherein at least one card position is designated as a bonus position. If a card designated as a winning card relative to a first paytable is positioned on a designated bonus spot, then a bonus event is awarded. In some variations, the bonus event is a fixed multiplier. In some other variations, the bonus event is a randomly selected multiplier. In some variations with randomly selected multiplier values, the selection is accomplished with a secondary determination mechanism not displayed to the player. In some other variations with randomly selected multiplier values, the selection is accomplished with a secondary determination mechanism such as the spin of a wheel or roll of a dice or any other kind of suitable mechanism that is displayed to the player. In some variations, the awarded multiplier applies to only the hand in which the winning card is positioned. In some other variations, in the case of a game with a plurality of hands, the awarded multiplier applies to all winning hands. In the case where two or more multipliers can apply to the same hand win, in some embodiments, the effective award multiplier is based on the product of the multipliers.

In some embodiments, a first bonus position designation is associated with a first award and a second bonus position is associated with a second first award. For example, a single hand video poker variation wherein the system randomly selects either a "2×" designation or a "3×" designation, randomly assigned to be displayed on the bonus-designated position, such that a winning card landing on a "2×" designation results in the doubling of standard payout for the win while a winning card landing on a "2×" designation results in the doubling of standard payout for the win.

In some embodiments, the designation of a randomly-selected position as a bonus position afresh for each game upon the start of the game. In some embodiments, the designation of a randomly-selected position as a bonus position afresh for each game at the start of the draw round. In yet other embodiments, the designation of the bonus position is fixed from game to game.

In some embodiments, the number of positions designated as bonus positions is the same from game to game. In some embodiments, the number of positions designated as bonus positions can change from game to game based on any suitable mechanism such as, but not limited to (a) prior player wins; or (b) prior player losses; or (c) attaining a specific non-winning hand outcome; or (d) attaining a specific winning-hand outcome; or (e) player's main game bet size; or (f) player's sidebet bet size; or (g) player's primary currency balance; or (h) player's secondary currency balance; or (i) player's loyalty program status; or (j) any other suitable mechanism; or (k) any combination thereof.

Considering embodiments applied to multi-hand Video Poker, there are a number of implementation variations. In some variations, a first position is randomly designated as a bonus position selected across all possible card positions. In some variations, a second position is randomly designated as a bonus position selected across all possible card positions.

In some variations, a first position is randomly designated as a bonus position selected within each of a plurality of hands. In some variations, each hand has an equal chance to contain one or more bonus-designated positions. In some variations, a first hand has a different probability of having one or more bonus-designated positions relative to a second hand. In some variations, only the base hand is assigned bonus-designated positions. In some embodiments that assign one or more bonus-designated positions to the base hand, the holding or replicating of a card in the base hand has no impact on whether or not the corresponding position in the non-base hands is assigned a bonus-designated position. In some embodiments that assign one or more bonus-designated positions to the base hand, the holding or replicating of a card in the base hand causes a change in the bonus-designation of the corresponding position in the non-base hands, such as, but not limited to: (a) making the corresponding non-base hand position a bonus-designated position in all non-base hands, (a) making the corresponding non-base hand position a bonus-designated position in at least one non-base hand, or (c) increasing the value the corresponding non-base hand position if it is already a bonus-designated position, or (d) any other suitable mechanism or (e) any combination thereof.

In a preferred embodiment, the methods of game play and presentation are implemented via a gaming machine or gaming system. Such a gaming machine may have various configurations.

The gaming machine may be located at a casino (and as such may be referred to as an "Electronic Gaming Machine"). As described below, the gaming machine may be part of a gaming system, such as a casino gaming system which links two or more of the gaming machines or one or more gaming machines with other devices, such as one or more table games, kiosks, accounting systems or servers, progressive systems or servers, player tracking systems or servers or the like.

One configuration of a gaming machine 22 is illustrated in FIG. 1. As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one first display device 28 configured to display game information. The display device 28 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touchscreen, a light emitting display (LED) or other suitable displays now known or later developed, in a variety of resolutions, sizes and formats (e.g. 4:3, wide-screen or the like). The display device 28 may be capable of projecting or displaying a wide variety of information, including images, symbols and other indicia or information associated with game play, game promotion or other events. The gaming machine 22 might include more than one display device, such as a main or first display device 28 and a secondary display device 30. The two or more display devices might be associated with the housing or, as illustrated in FIG. 1, the gaming machine 22 might also include a top box or other portion which includes the one or more second display devices 30. Also, the gaming machine 22 might include side displays (such as mounted to the exterior of the housing 26) and might include multiple displays of differing sizes.

As described in more detail below, the gaming machine 22 is preferably configured to present one or more games upon a player making a monetary payment or wager. In this regard, as described in more detail below, the gaming machine 22 includes mechanism or means for accepting a monetary value or any equivalence thereof.

In one embodiment, certain game outcomes (but preferably not all game outcomes) may be designated as winning outcomes (the non-winning outcomes may be referred to as losing outcomes). Prizes or awards may be provided for winning outcomes, such as monetary payments (or representations thereof, such as prize of credits), or promotional awards as detailed herein. As detailed below, the gaming machine 22 preferably includes a mechanism or means for returning unused monetary funds and/or dispensing winnings to a player.

The gaming machine 22 preferably includes one or more player input devices 32 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game, to initiate designated markers marking "lucky spots," to "cash out" of the gaming machine, or to provide various other inputs.

Figure 2:
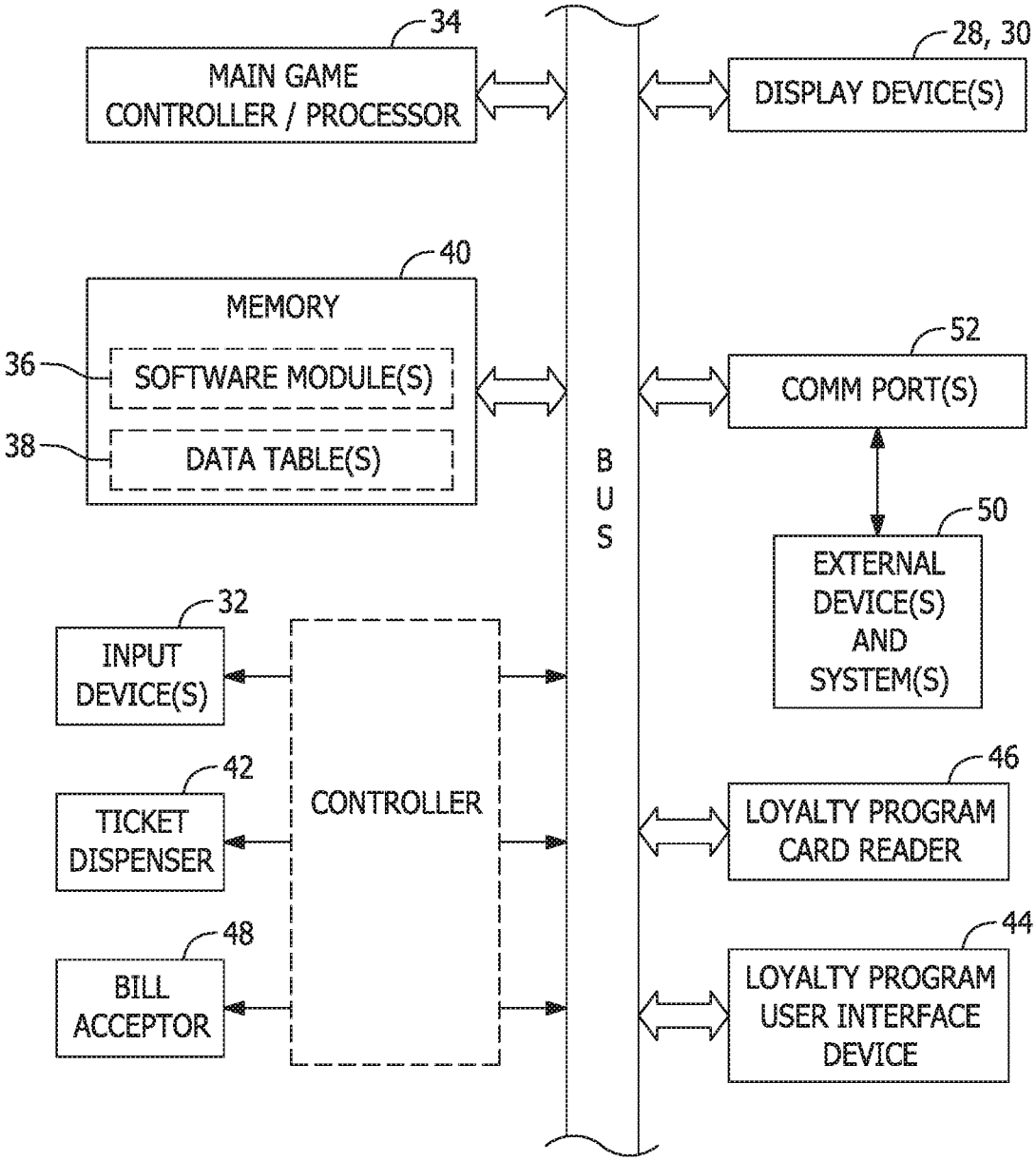
FIG. 2 shows a schematic of elements of the gaming machine of FIG. 1

Referring to FIG. 2, in one preferred embodiment, the gaming machine 22 includes at least one microprocessor or controller 34 for controlling the gaming machine, including receiving player input and sending output signals for controlling the various components or peripheral devices of the machine 22 (such as generating game information for display by the display devices 28,30). The controller 34 may be arranged to receive information regarding funds provided by a player to the gaming machine 22, receive input such as a purchase/bet signal when a purchase/bet button is depressed, and receive other inputs from a player. The controller may be arranged to generate information regarding a game, such as generating game information for display by the at least one display device 28,30 (such as information comprising lucky spot features and relocatable gaming pieces, as detailed below), for determining winning or losing game outcomes and for displaying information regarding awards for winning game outcomes, among other things.

The controller 34 may be configured to execute machine readable code or "software" or otherwise process information, such as obtained from a remote server. Software 36 or other instructions may be stored at a memory or data storage device 40, e.g. in a fixed or non-transitory configuration. The memory may also store other information or data 40, such as data stored in table or other forms (including, but not limited to look-up tables, pay tables and other information including tracked game play information). The gaming machine 22 may also include one or more random number generators for generating random numbers (such as implemented by a pseudo-random number generator software module stored in the memory 40 and executable by the processor 34), such as for use in dealing game pieces to a player, for selecting lucky spot positions on one of a plurality of positions in a predetermined game layout, for selecting multiplier values, or for positioning game elements in a random fashion whether or not player input is used by the gaming machine to affect the positioning.

Preferably, the controller 34 is configured to execute machine readable code or instructions (e.g. software) which are configured to implement the game. In this regard, the gaming machine 22 is specially configured to present the game of the invention via specific software and/or hardware which causes the gaming machine to operate uniquely. For example, the controller 34 of the gaming machine 22 may be configured to detect a wager, such as a signal from a player's depressing of the "bet one" button. Upon such an event and/or the player otherwise signaling the gaming machine to present the game, the controller may be configured to cause the at least one display 28 to display unique information, such as a unique graphical interface or unique game display, including game symbols or other game information. The controller may accept input from a player of game inputs, such as a request to spin reels or the like, via the one or more player input devices of the gaming machine 22. As indicated above, the machine readable code may be configured in various manners, such as by having various "modules" of software which are designed to implement specific features of the game play or game presentation.

The gaming machine 22 may be configured to generate and present games in a stand-alone manner or it may be in communication with one or more external devices or systems 50 at one or more times. The gaming machine 22 might communicate with one or more of such external devices or systems 50 via one or more communication ports 52 or other interface devices. These ports or interface devices 52 may be configured to implement various communication protocols (including proprietary protocols) and communicate via wireless, wired or other communication link. For example, the gaming machine 22 may be configured as a client based device and obtain game code or game outcome information from a central game server (in which event the gaming machine controller may receive game information from the server, such as game outcome information, and use that server-generated information to present the game at the gaming machine).

For example, a gaming machine in a Class II gaming system whereby a central server sends game outcome information based on a physical or electronic pull-tab or based on a Bingo game outcome. For another example, a gaming machine in a Video Lottery Terminal system whereby a central server sends game outcome information based on an electronic lottery ticket, or based on a random number generator or based on a pseudo-random number generator. For another example, a personal video game device such as a mobile phone, tablet, laptop, desktop, PDA or any suitable personal video game device in an online or mobile client-server system whereby a central server sends game outcome information of any kind.

As indicated, the gaming machine 22 is configured to present one or more wagering games. The gaming machines 22 is preferably configured to accept some form of funding, such as funding in the form of coins, tokens, paper currency, Ticket-In-Ticket-Out (TITO) tickets, virtual currency, free play credits or other suitable funding elements, objects or devices representing value such as monetary funds. Thus, as indicated above, the gaming machine 22 preferably includes a mechanism or means for accepting monetary value. For example, the gaming machine 22 might include a media reader such as bill/ticket acceptor 48 for accepting paper monetary currency and/or an equivalence of monetary currency such as TITO tickets. Not shown are associated devices for the reading, verification and storage of the paper monetary currency and/or monetary currency equivalents, nor the communication infrastructure between the associated devices and the at least one control processor within gaming machine 22. In another embodiment not show, the gaming machine 22 might include a coin acceptor for accepting, validating and storing coins.

The gaming machine 22 might also be configured to read FOBs, magnetic stripe cards or other media having data associated therewith and via which value or funds may be associated with the gaming machine 22. The mechanism for accepting monetary value might also comprise hardware and/or software which allows a player to transfer (such as electronically) funds from an account, such as a casino wagering account, or a bank or other financial institution account. Such a mechanism might include a communication interface which permits the gaming machine to communicate with a mobile phone, PDA, tablet or other electronic device of the player (such as via a physical interface or wired or wireless communications, such as to enable the transfer of funds from the player to the gaming machine or system.

When the player associates funds with the gaming machine or an associated system, a credit balance is generated. The amount by which given funds are converted to credits is usually referred to the given game's "denomination". For example, inserting a $100 bill into a gaming machine with a $1 denomination results in a credit balance increase of 100 credits, whereas inserting a $100 bill into a gaming machine with a $5 denomination results in a credit balance increase of only 20 credits. Therefore, there is a direct correspondence between the number of credits wagered and the actual funds put at risk for the wager. The credit balance may comprise a plurality of monetary value credits. The player may wager some or all of the associated monetary value, such as by wagering one or more of the credits associated with the credit balance. For example, in a gaming machine with a $1 denomination, the player might provide input to a wager button or touch screen interface to wager a certain number of credits (such as "Bet 1 Credit", "Bet 5 Credits", "Bet Maximum Credits" or other options) which is essentially specifying a wager of the same number of dollars as credits. In a similar example with a gaming machine with a $0.25 denomination, each credit wagered is essentially specifying a wager of a quarter. In one embodiment, when the player's wager is received, the player's credit balance is reduced by the number of wagered credits. The player might then provide a separate input to begin the game. In other embodiment, the player might select a "play game" input, such as by pressing a "spin" button or "deal" button, which input is taken to comprise both an instruction to place a wager (such as of a pre-set or pre-selected number of credits) and to start the game. Of course, other configurations may be implemented for accepting monetary value from the player and for allowing the player to place a wager from the associated monetary value.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. These winnings may be associated with the player's credit balance, thus increasing the player's credit balance.

In one embodiment, the player may provide an input to the gaming machine 22 to indicate their desire to cash out, such as by selecting a "cash out" button or a "collect" button or a touch screen feature or providing other input. In response, a monetary value represented by the player's credit balance or the like is preferably paid, transferred or otherwise provided to the player. For example, upon an award or at cash-out, associated funds may be paid to the player by the gaming machine 22 a media such a TITO ticket from a TITO ticket dispenser 42, wherein the TITO ticket represents the value which was paid or cashed out of the machine. In another embodiment not shown, funds may be issued by dispensing coins to a coin tray. In another embodiment not shown, funds may be issued by dispensing paper currency or other media. The aspects of gaming machine "ticketing" systems are well known. One such system is described in U.S. Pat. No. 6,048,269 to Burns, which is incorporated herein in its entirety by reference.

In yet another embodiment, the cash-out might result in the dispensing of a card or other media which stores or represents the cashed-out funds, such as by writing funds information to a magnetic stripe of a card which is inserted into a media writer of the gaming machine or dispensed from the machine. The media writer may also update a value on other media, such as a player tracking system or loyalty program card. In other embodiments, the cash-out mechanism may result in the funds value being transferred to an external device or account, such as a player's casino account (such as associated with a casino server), a remote bank or other financial account, or an electronic device such as a player's phone, PDA or tablet.

The gaming machine 22 may also include a player loyalty program card reader 46, and a loyalty program user interface device 44. The interface device 44 may include a display device, and/or a player input device such as a keyboard, touch screen, or other input device. In some embodiments, the interface device 44 may include an interface to communicate with an external input device such as a player's mobile phone, PDA, or any other suitable external input device (the external device being a separate device from the gaming machine 22). Such player loyalty program cards are well known and may permit the game operator to track play of the particular player of the gaming machine whose player loyalty program card is inserted into the gaming machine. The play tracking may be used to award the player with loyalty program points, the accumulation of which results in some benefit to the player.

As illustrated in FIG. 2, the main game controller or processor 34 may communicate with several of the peripheral devices via one or more intermediary controllers. For example, some of the peripheral devices might comprise USB type or enabled devices which are controlled by an intermediary USB controller.

A casino may have numerous such gaming machines 22, such as located on a casino floor or in other locations. Of course, such gaming machines 22 might be used in other environments, such as an airport, bar or tavern or other locations.

It will be appreciated that the gaming machine illustrated in FIGS. 1 and 2 is only exemplary of one embodiment of a gaming machine. For example, it is possible to for the gaming machine to have various other configurations, including different shapes and styles and having different components than as just described. For example, instead of comprising a "casino"-style gaming machine, it is possible for the game of the invention to be presented on a computing device, including at a home or office computer or a player's mobile electronic device such as a PDA, phone or the like. In one embodiment, a player might log in to a casino server and the controller of the casino server may cause game information to be delivered to the player's computer via a communication link and then be displayed on a display of the player's computer. The communication link might comprise or include the Internet, a casino network such as a wired or wireless LAN, or combinations of public and/or private networks including wired and/or wireless links. In such a configuration it will be noted that the term "controller" may comprise more than one device. For example, in a server-based environment, a controller at a server may generate game information and transmit that information to a local controller at a gaming machine or a player's computer or other electronic device. The local controller at the gaming machine or the player's computer or other electronic device may then cause game information to be displayed on one or more associated displays.

The gaming machine 22 may, as noted above, be part of a system which includes other devices. For example, the gaming machine 22 may communicate with one or more casino systems, such as a player tracking server or system, an accounting system or server, a ticketing system, a bonusing system, a tournament system, other gaming machines, and external devices.

In some embodiments, a gaming system comprised of multiple devices in two or more separate locations within the same facility or different facilities are provided. Such systems may include a Video Lottery Terminal implementation or a Class II system implementation wherein game outcomes are generated in at least one central server which communicates with one or more player terminals on the casino floor via one or more wired or wireless connections.

Some embodiments are implemented via one or more gaming devices owned by the player for the wagering and winning non-monetary virtual currencies such as playing a game on a personal computer, computing tablet, smart phone, personal digital assistant (PDA) or any suitable device which does not require the use of a public network and/or a private network once the game has been loaded or downloaded on the device.

Some embodiments are implemented via gaming system comprised of multiple devices owned and/or operated by separate parties in different location such as for secured client-server gaming for wagering and winning in one or more monetary currencies, or for secured client-server gaming for the wagering and winning in one or more non-monetary virtual currencies, or for non-secured client-server gaming for the wagering and winning in one or more non-monetary virtual currencies, where communication between the devices includes the use of public networks such as via the Internet and/or such as via mobile device and/or the use of private networks such via a privately owned wired networked and/or via a privately owned wireless network.

Figure 3:
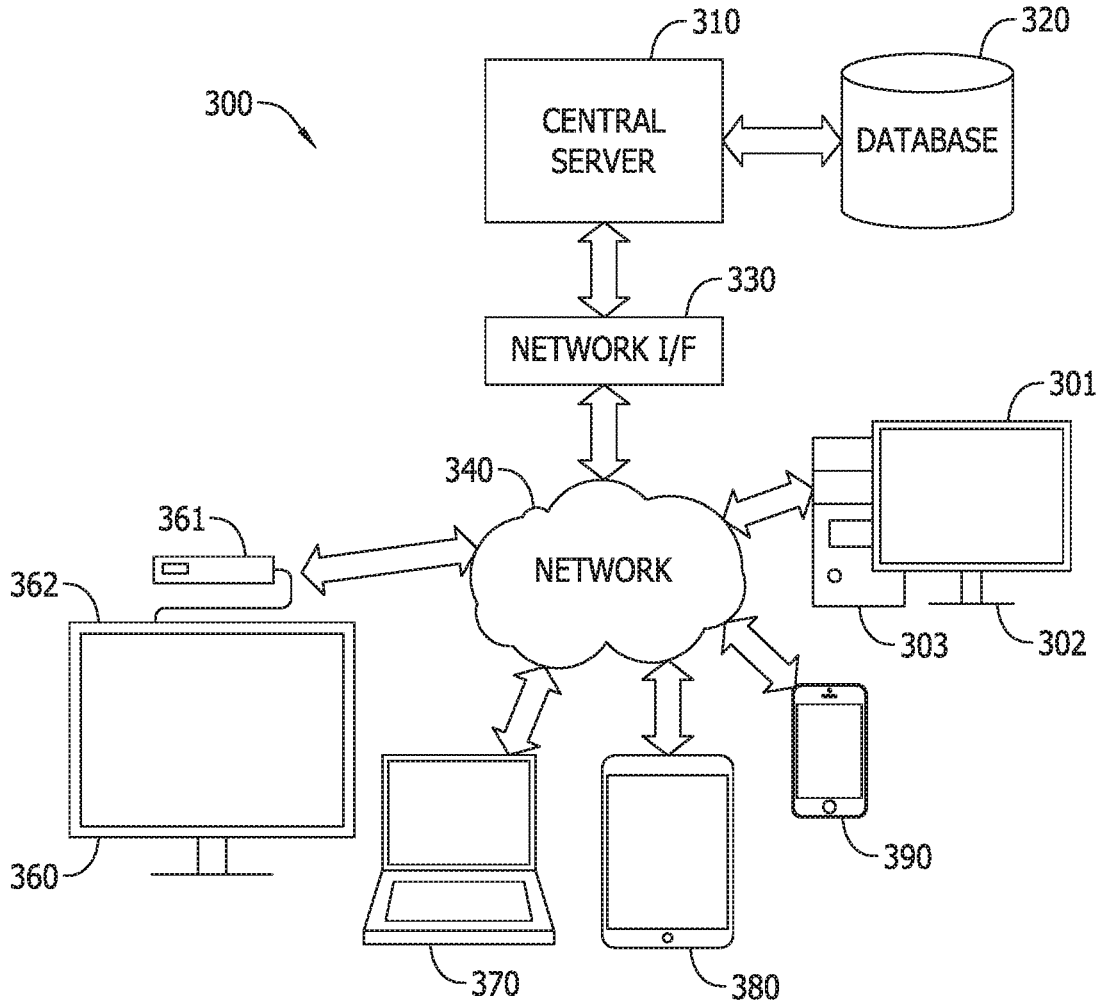
FIG. 3 shows a client-server gaming system according to one exemplary embodiment.

FIG. 3 shows an exemplary client-server gaming system. The client-server gaming system 300 may include at least one Central Server 310 connected to at least one Database 320 and connected to at least one Network Interface device 330. The Central Server performs numerous functions including game content control; game outcome generation including at least one random number generator mechanism; player bankroll adjustments due to player actions such as the depositing of monetary fund, withdrawing monetary funds, earning or purchasing virtual currency, the placing of a wager, payouts based on winning game outcomes; player account support; providing transactional data to the Database 320; retrieving historic data from the Database 320; storing and retrieving game-state data; and other functions appropriate for the management and control of a cash-based casino, and/or a virtual-currency based social game or social casino.

In some embodiments not shown, different types of Central Server functions are performed by a plurality of separate computer server hardware devices. In some embodiments not shown, a given Central Server function is performed by a plurality of separate computer server hardware devices. In some embodiments, the Database 320 and the Central Server 310 are implemented within the same computer hardware device. In some embodiments, the Database 320 is implemented via one or more computer hardware device separate from the Central Server 310. In some embodiments, the Network Interface 330 and the Central Server 310 are implemented within the same computer hardware device. In some embodiments, the Network Interface 330 is implemented via one or more computer hardware device separate from the Central Server 310. In some embodiments whose implementation of the Central Server 310, and/or the Database 320, and/or the Network Interface 330 includes a plurality of computer hardware devices, the computer hardware devices are all located in the same facility. In some embodiments whose implementation of the Central Server 310, and/or the Database 320, and/or the Network Interface 330 includes a plurality of computer hardware devices, at least one first computer hardware device is located in a different facility from at least one second computer hardware device.

The Network Interface 330 connects a Network 340 to which to one or more client devices 360, 370, 380, 390, 301 are also connected where the Network 340 is the Internet, or a mobile phone network, or a wireless network within a particular location or any suitable network. The example client devices include (a) a system 360 comprised of a TV or other video display 362 and an external device such as set-top box 361, or any suitable external device, or any suitable device built-into the TV or other video display 362; (b) a laptop 370 or other personal computing device; (c) a computing tablet 380; (d) a mobile device 390 such as smart phone or PDA or any suitable mobile game device; (e) a desktop computer 301 which may have a display 302 and associated computer hardware 303.

Typically, software is loaded or downloaded into a client device which controls the display of the game to the player. For secure client-server embodiments for some virtual-currency implementations and typically for all monetary-currency implementation, all game outcomes are generated on a Central Game Server 310. For non-secure client-server embodiments for some virtual-currency implementations, the Network 340 connectivity is required for player account information and/or game state information but game outcomes are generated via client-based software.

Figure 4A:
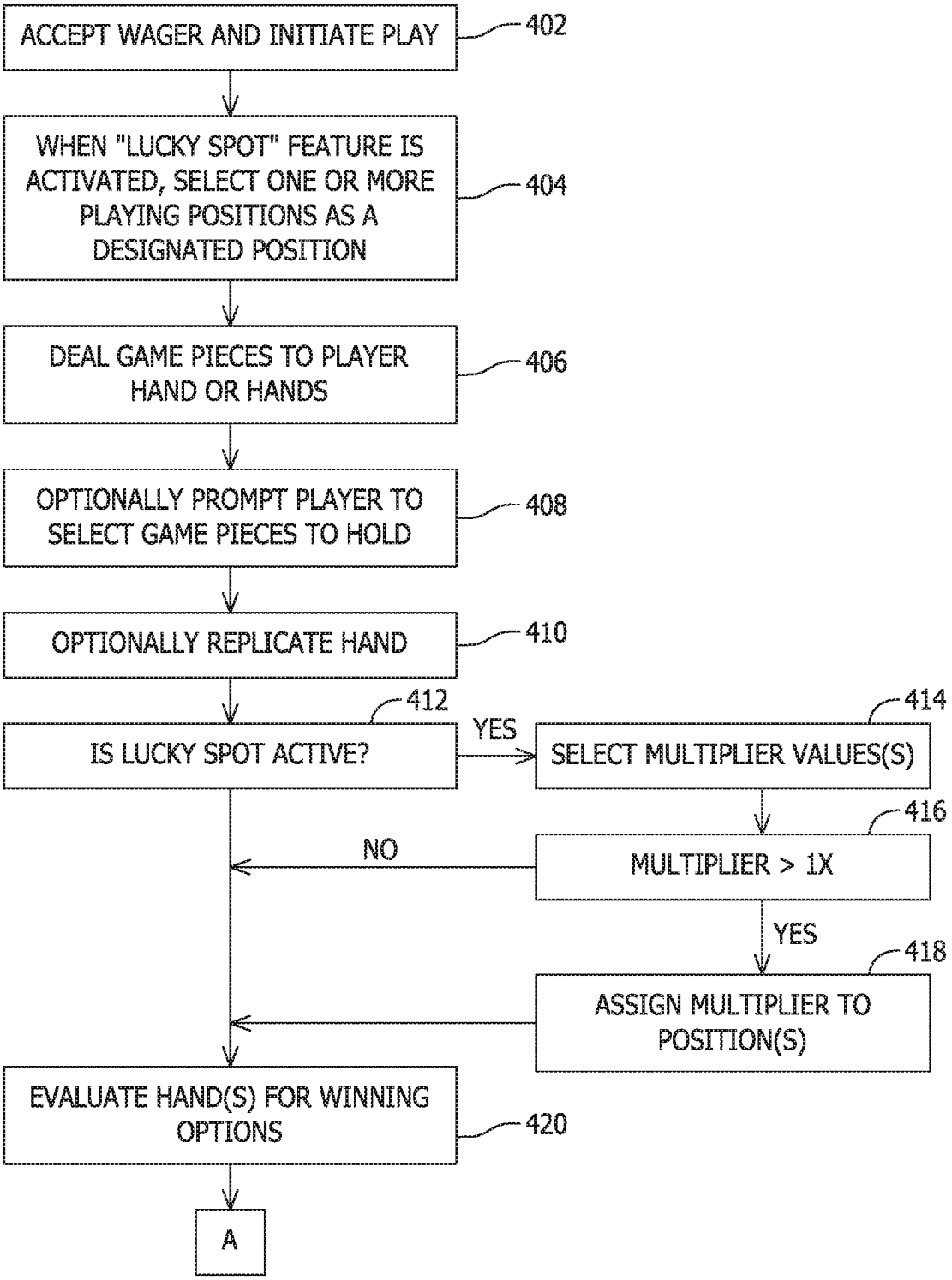
FIG. 4A and FIG. 4B show a gaming machine, according to one exemplary embodiment.
Figure 4B:
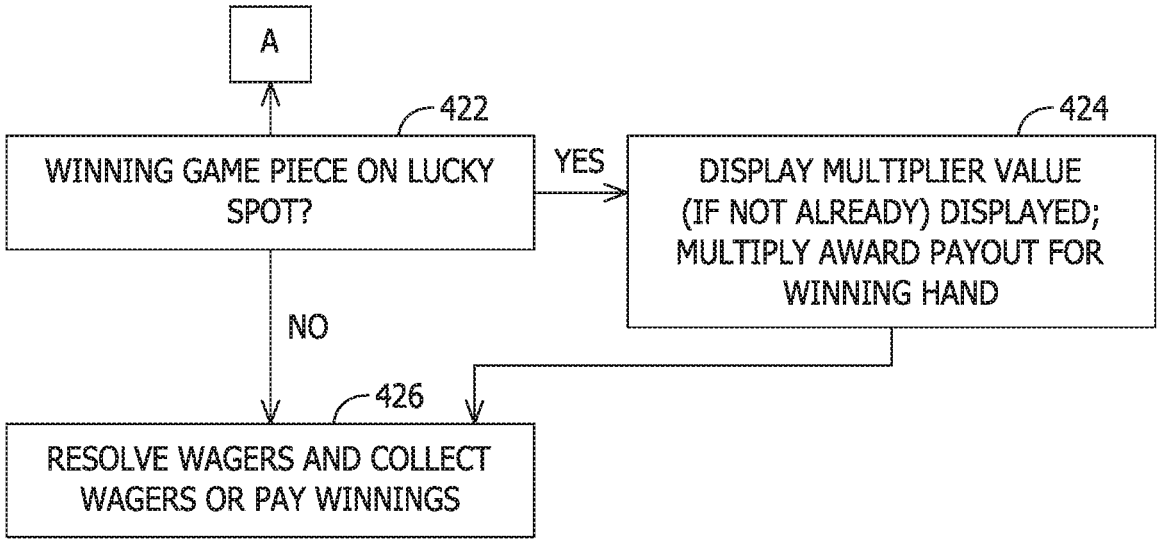

A method of playing a game will be described in relation to FIGS. 4A and 4B. The sample game play summary makes reference to video poker type games. However, this reference is merely to aid explanation, and the method may be applied to any number of games. A player may place an initial wager to play a game as shown in step 402. For example, a wager of a certain amount of credits at a gaming machine may be required to play video poker. Of course, other monetary currencies, virtual currencies, reward points, etc. may be used to place a wager and initiate play. A player may also place an extra wager in addition to the game wager in order to play the game with a "lucky spot" feature enabled.

The game is played according to the standard rules, for example the rules of video poker. When the player has activated the lucky spot feature, one or more of the card positions is randomly selected and designated as a lucky spot as shown in step 404. In some embodiment, a plurality of card positions is designated. In some embodiments, a random number of card positions is randomly selected and visually designated. In other embodiments, the card positions form a predetermined pattern among the card positions. It noted, in some instances the number of card positions may be the same as the number of cards in a hand dealt to a player. In other instances, there may be more positions than the number of cards in a hand, such that not all positions will be covered by a card in the hand.

The lucky spot card position(s) may also be determined in a number of ways, such as being designated by the player, or being a permanent position or positions in the game. The lucky spot position(s) may represent a bonus value such as a multiplier or bonus credit/cash award. In some embodiments, if a card located on the designated card position(s) is one of the required cards to form a winning outcome, then a bonus is activated which may provide a bonus award, such as a multiplier value that is applied to the payout of the corresponding award as described in more detail below. In other embodiments, the bonus may include one or more free plays of the base game, or one or more different bonus games.

In step 406, a game is initiated by dealing game pieces to the player. For example, in a video poker type game, a certain number of playing cards may be dealt to the player and displayed on the display of the gaming machine. In other embodiments, a certain number of dice may be rolled. In some games, the player may play multiple hands at once. In others, there may be only a single hand.

In step 408, the player may optionally select game pieces to hold, and initiate the exchange of non-held game pieces with replacement game pieces according to rules of a base game. For example, to form a poker hand in some poker type games, the player may hold a predetermined number of cards, and the discarded cards may be replaced from cards in the deck. In some embodiments, the player may only play a single hand per play of the game. In some embodiments, the player may play more than a single hand per play of the game such as is described in U.S. Pat. Nos. 5,823,873 and 6,007,066. Where multiple hands are played, the held cards may be replicated across all hands as shown in step 410, and different replacement cards may be dealt to each of the hands. Other variations are also possible based on the rules of the base game.

When the lucky spot feature is designated or active as determined in step 412, the process proceeds to step 414. The lucky spot feature may be activated based on any number of criteria. For example, the lucky spot may be a part of an optional or mandatory side wager. In other instances, the lucky spot feature may be activated upon a "max bet" in a base game. The lucky spot may be activated by playing a predetermined number of simultaneous hands in a game, or if the game is being played at a specific denomination. Other criteria such as a predetermined amount of points from a player tracking or loyalty program system may be used. When the lucky spot feature is determined not be active the process proceeds to step 420.

In step 414, a multiplier value may be assigned to the lucky spot or designated position(s). In some embodiments, the multiplier is determined randomly from a set of possible multiplier values. Other variations are also possible such as fixed multipliers that are assigned to the designated position (s). In some instances, the multiplier may be displayed to the user as a sub-feature of the game, such as a result of a wheel spin, die throw, pick of a random card or object, a prize from a treasure chest, etc. The multiplier may also be based on other aspects of the game such as the number of active hands, the amount of a base wager or side wager, or the like. In some embodiments, the multiplier value may be visually displayed to the player prior to a game outcome. In other embodiments, the multiplier is not revealed to the player until after a game outcome.

In step 416, it is determined whether the selected multiplier value is more than a 1× multiplier. That is, in some embodiments, a selected multiplier value may end up being a 1× multiplier value where the lucky spot randomly does not provide a bonus for that game. When the multiplier value is not more than a 1× multiplier, then the process proceeds to step 420. When the multiplier value is greater than a 1× multiplier, the process proceeds to step 418.

In step 418, the selected multiplier values are assigned to the lucky spot position(s). For example, when there are multiple hands or more than one designated position in a hand, the selected multipliers are assigned to each of the designated positions among the hands. In some embodiments, the multipliers may be assigned by player input. That is, the player chooses which of the selected multipliers is placed on the available designated positions.

In some instances, multiple multipliers may be placed on a single position. Where more than one multiplier is placed on a single position, the effect may be that the multipliers on that position are added together (a ×2 and a ×3 multipliers become a ×5 multiplier) or multiplied together (a ×2 and a ×3 multipliers become a ×6 multiplier). The multipliers may be combined with other bonuses associated with the game or the hand, or may be separate. In some instances, certain multipliers may be preassigned to certain positions. In other embodiments, other bonus events in place of the multipliers may be used, the awarding of a cash prize; or the awarding of a physical prize such as a commemorative coin, or a vehicle, or a voucher which can be exchange for specific items or services, or any suitable physical prize; or the triggering of a bonus game such as a free spins bonus, or a pick-based bonus game, or wheel spin bonus game, or any suitable bonus game.

In step 420, the hands(s) are evaluated for winning outcomes. In a poker type game, the hand(s) may be compared to a predetermined set of winning hands such as a straight, a full house, etc. The winning hands may be any one of the winning hands based on payouts displayed in a pay table, or the winning hands may be hand that outranks a dealer hand or other criteria.

Once any winning hands are identified, it is determined whether a game piece that is part of the winning hand is on the lucky spot in step 422. If so, in step 424 the multiplier value for the lucky spot is displayed (if not already displayed in steps 414, 416, and 418) and the winning award payout for the winning hand is increased by the multiplier value. In some embodiments, the multiplier and the multiplier position (lucky spot) are not revealed to the player until step 424. Finally, in step 426, the wagers are resolved and paid out or collected based on the results of the game.

Accordingly, when the player has activated the lucky spot feature, and there is at least one winning hand at the end of play, one or more lucky spots may be randomly designated on any card position in any hand. If the card located on the designated card position is a required card to form the winning outcome, then a bonus is activated which may provide a bonus outcome such as randomly awarding a multiplier value that is applied to the payout of the corresponding award. If a given winning hand is comprised of two or more winning cards that are on designated positions, the payout for that hand may be multiplied based on the product of the corresponding multipliers More generally stated, gameplay may proceed in the disclosed embodiments as follows: accepting a wager, randomly selecting k relocatable indicia from a set of N possible indicia, where N>k, positioning the k indicia into j possible locations (j>=k), evaluating the k indicia relative to a first paytable with payout rules based solely on the indicia values, evaluating the k indicia relative to a second paytable with payout rules based on at least the location of the indicia, and awarding any prizes earned.

A number of modifications and variations may be made to the above-described method for playing a game. For example, different ordering of display to the player such as when the multiplier value of a given designated position is indicated at a later stage of the game relative to when the given designated position is indicated, such as after final hand evaluation or such as after a final hand evaluation in which a secondary payout is earned. Another example of different ordering of display to the player is when designates spots are indicated to the player only after all game element replacement decisions have been made by the player.

In another example, when there are multiple positions designated as lucky spots, a player may win a bonus award only if all of the positions are covered by game pieces that form a part of the winning hand. In other embodiments, only a predetermined number of the multiple lucky spots must be covered. For example, an award can be given for each lucky spot that is covered by a winning game piece, for two or more lucky spot, or for any other criteria.

In other embodiments, a player may play against a dealer or a second player. Here, instead of comparing outcomes to a pay table, outcomes for each player, or the player and the dealer, are compared to determine which of the player(s) and/or dealer has a higher ranking hand. In some embodiments, a lucky spot may increase a value of the hand such that a hand that is typically a lower ranking hand may outrank a higher ranking hand based on the lucky spot(s). In other embodiments, outcomes determined by the lucky spot(s) may be a bonus outcome separate from the outcome resulting from the comparison of the hands.

In some embodiments, the number of positions available exceeds the number of gaming pieces that are dealt to the player. In this instance it is possible that a designated lucky spot may not be covered by any gaming piece that is dealt to the player. Such embodiments may be advantageous in some instances because they allow the gaming operator to greatly increase an award provided by the lucky spot(s) due to the decreased probability that a winning gaming piece is positioned on the lucky spot(s).

According to another exemplary embodiment, the methods of game play and presentation may be presented via physical gaming pieces. For example, a physical deck of playing cards or a number of physical dice may be implemented. In the disclosed embodiments, a playing surface, including a number of indicia positions may be provided. For example, a playing surface may denote one or more positions in which one of the physical game pieces used during play is to be positioned. In a further embodiment, there is a device that directs a random assortment of game pieces into the predetermined positions. For example, when the physical game pieces comprise dice, there may be device with a number of slots, pockets, or depressions that corresponds to the number of dice in which the dice may be randomly thrown. In this manner, the dice take up one of the positions demarcated by the slots, pockets, or depressions to establish the position of the dice.

In some embodiments, a playing surface may include features such as lucky spot indicators highlighting a position, slot, or pocket to a player so the player is award of the spot or spots having multiplier values. Such lucky spot indicators may be in the form of lights adjacent to or surround the positions of the gaming pieces used during the game.

In one exemplary embodiment, a game is presented with dice having faces that correspond to a standard deck of playing cards. For example, there may be nine dice each having six faces. The faces of the dice correspond to the cards of a standard deck 52 playing cards as well as two wild cards, such as joker cards. The cards corresponding to each face of the dice may be configured to allow for each traditional winning poker hand to be achieved using the set of dice. Such a system is explained in further detail in U.S. Pat. No. 7,871,077, the contents of which are hereby incorporated by reference. The dice may be physical game pieces or may be electronically generated on a gaming device such as the gaming device 22 described above.

Figure 5A:
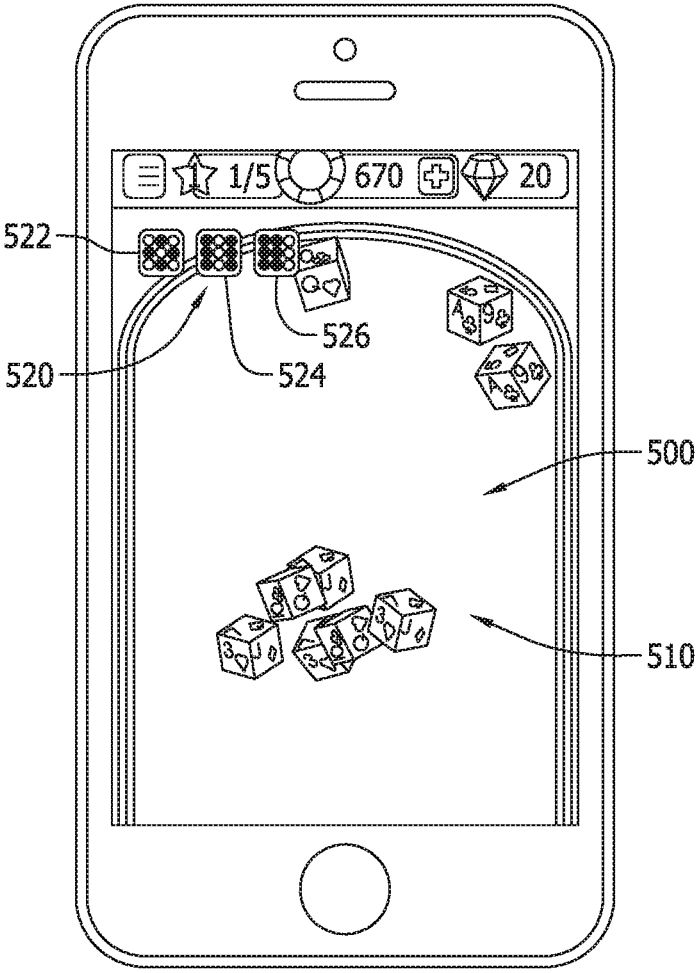
FIG. 5A, FIG. 5B, FIG. 5C, FIG. 5D, FIG. 5E, and FIG. 5F, show an example of game play for playing a game awarding prizes according to locations of winning relocatable gaming indicia, according to one exemplary embodiment.
Figure 5B:
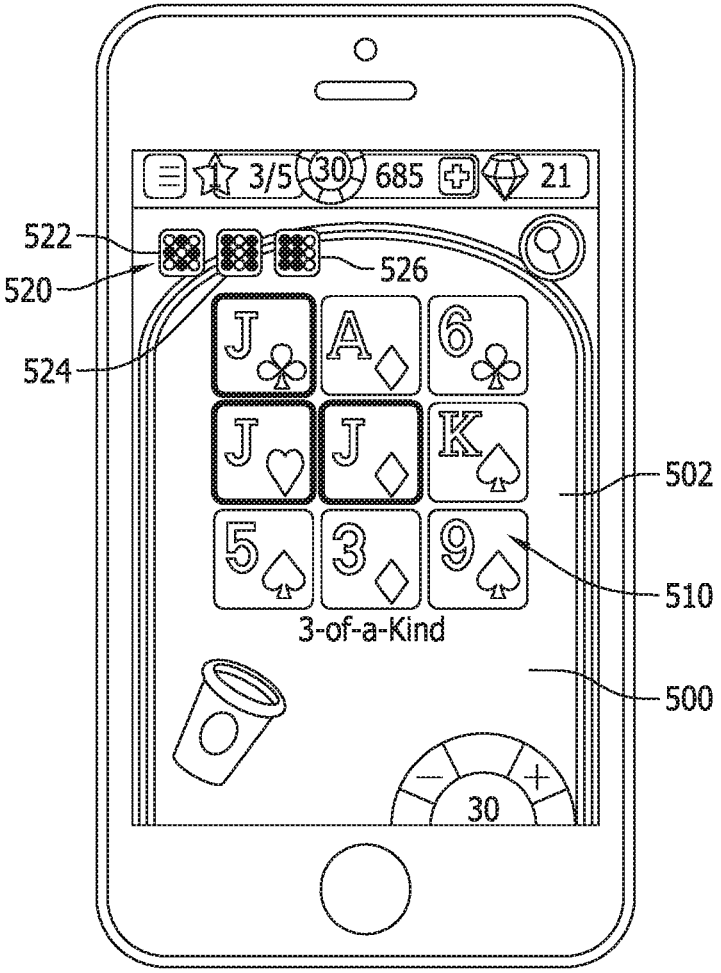
Figure 5C:
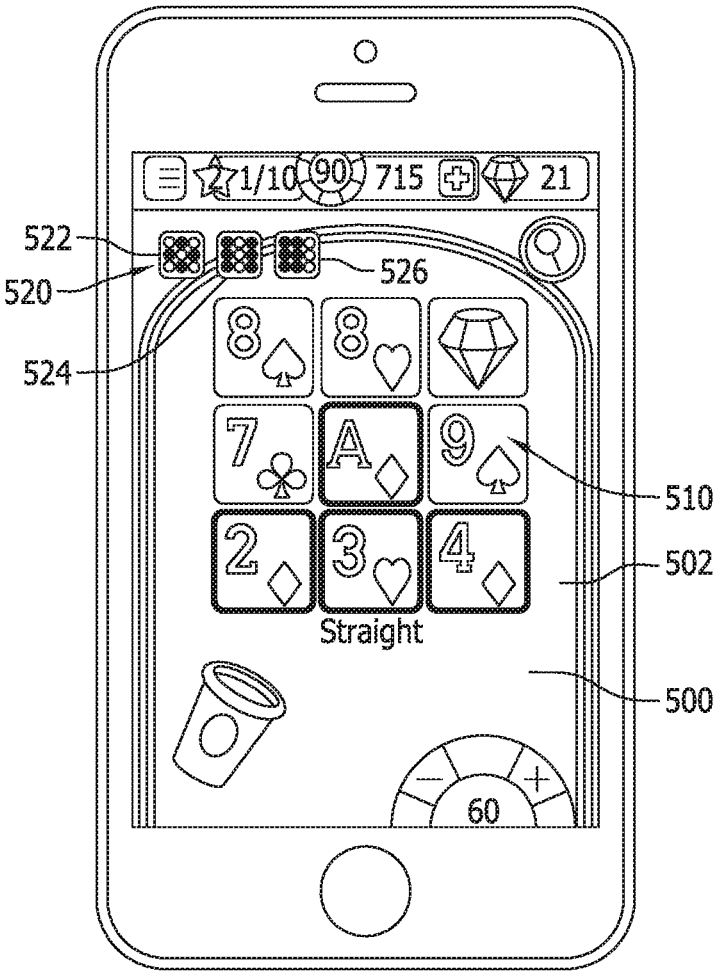

FIGS. 5A-4G show a particular implementation using dice with faces corresponding a standard deck of playing cards. While this implementation is shown as displayed on a gaming device, the implementation may also be via physical dice. In FIG. 5A, a set of dice 510 is rolled on a physical or virtual playing surface 500 to randomly select one of the indicia disposed on the faces of each die. Furthermore, the dice 510 are configured to fall into one of a number of predetermined positions 502. In FIG. 5B, it is shown that the dice have landed to show one face of each die 510 face-up. Further, the dice 510 are directed into a 3×3 grid 502. While a 3×3 grid is used in this embodiment, any other desired pattern of positions may be incorporated.

The dice 510 may be randomly assigned to positions within the grid 502 on each roll, such as via results from a random number generator. In other embodiments, the dice 510 may each be assigned to a particular location within the grid 502. As another option, the dice 510 may fall into positions on the grid 502 based on a physics engine simulating the dice 510 falling and bouncing against each other. Or in the case of actual dice 510, the positions are determined by the dice 510 falling and bouncing into different pockets or depressions forming the grid 502 on the playing surface 500.

In some instances, the dice 510 may be thrown or rolled simultaneously. In other instances, the dice 510 may be thrown in stages such as one at a time or at a group at a time. When the dice 510 are thrown in stages, the dice 510 in subsequent throws may affect the position and/or the value of the dice already on the playing surface 500 from a previous throw such as when the newly introduced dice 510 hit dice 510 already on the playing surface.

In this embodiment, designated positions on the grid 502 correspond to a secondary bonus award, multiplier, or the like as described above. The bonus award is achieved when winning dice are disposed in the predetermined bonus positions. Here, as shown in FIGS. 5A-5D, three bonus patterns 520 have been identified. A first bonus pattern 522 includes corner positions and a center position of the 3×3 grid 502. A second 524 and a third bonus pattern 526 include a center and a right vertical column of the 3×3 grid 502. Of course, other patterns and positions may be identified as bonus positions including a single position to any five positions of the 3×3 grid 502.

As shown in FIG. 5B, the indicial showing face-up on the dice 510 are compared to traditional poker hand rankings to determine whether a player wins the dice poker type game. In FIG. 5B, a 3-of-a-kind hand has been created with the J♣, J♥, and the J♦ all landing face up on the dice. However, bonus award is not awarded because the winning indicia do not correspond with one of the predetermined winning patterns 520. Similarly, in FIG. 5C, a straight is achieved by a player without triggering a bonus award.

Figure 5D:
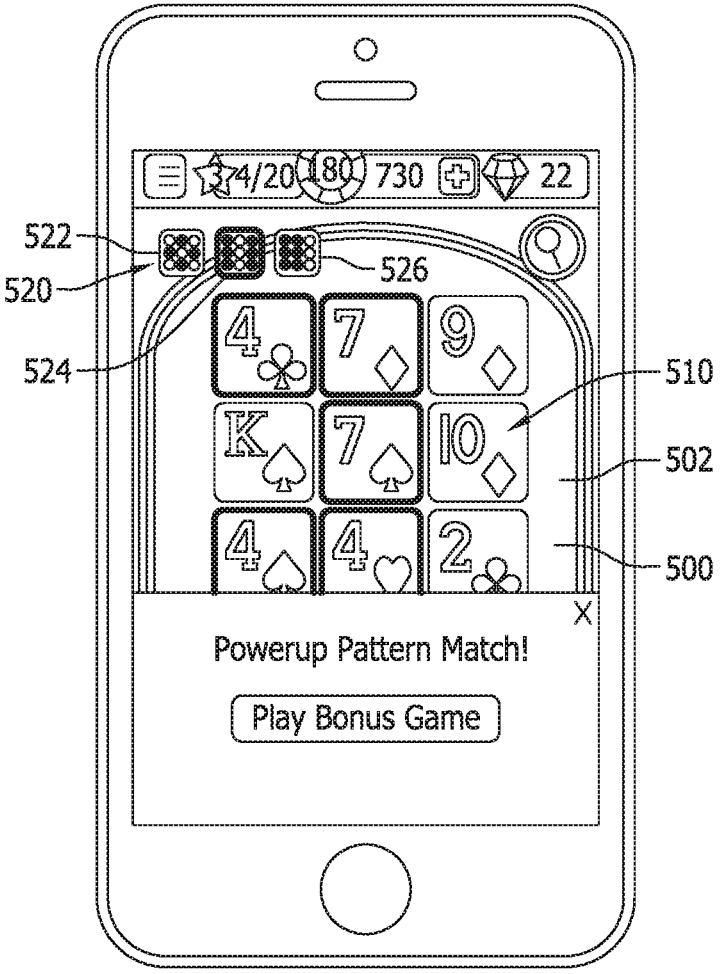

In FIG. 5D, however, a bonus award is triggered. Here, as a result of rolling and positioning the dice 510, a full house is achieved on the dice 510 with a 4♣, 4♠, 4♥, 7♠, and 7♦. Further, three of the winning dice correspond with the predetermined bonus position 524 of the center column of the 3×3 grid. Thus, not only is the player awarded for achieving the winning hand, but a bonus award is also triggered. The bonus award may be any number of awards as described above. Here, the bonus award allows the player to participate in a bonus game.

Figure 5E:
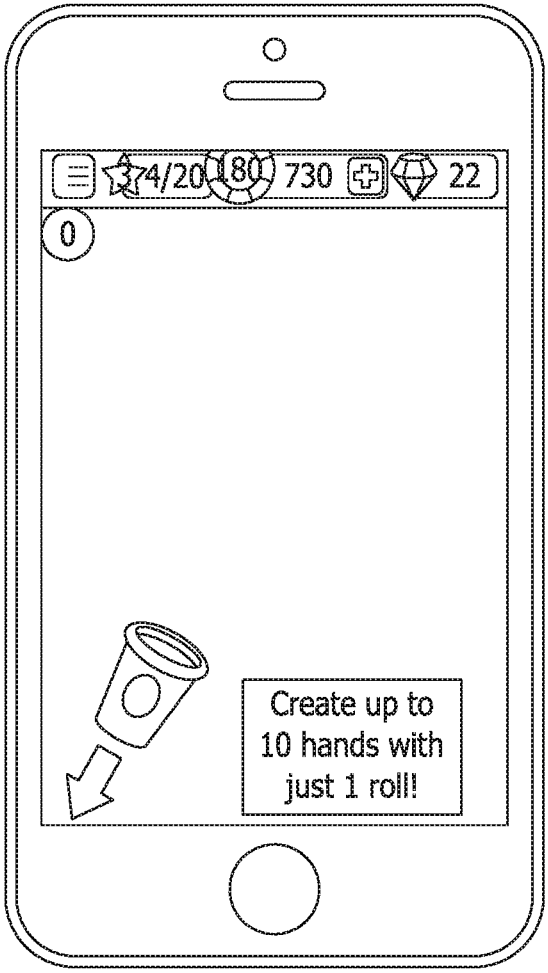
Figure 5F:
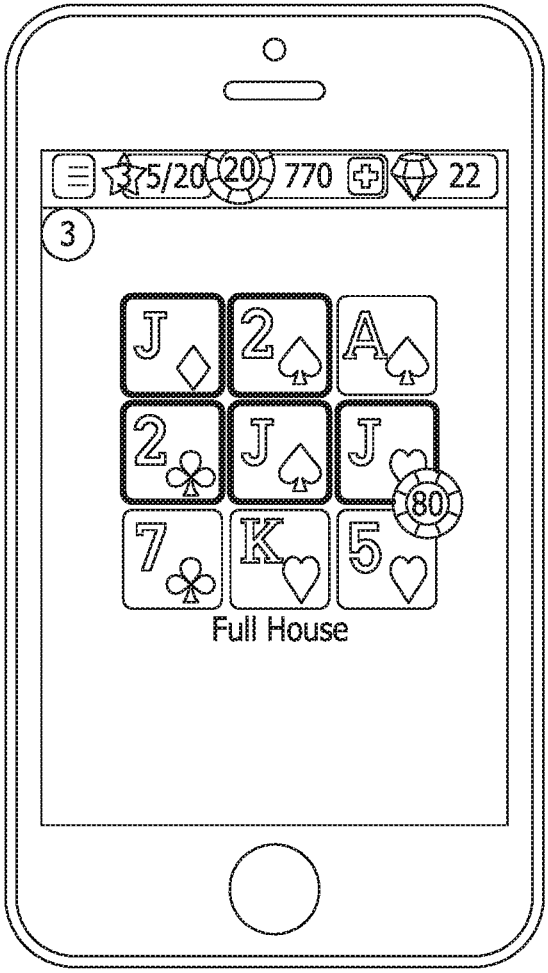

In FIG. 5E, a bonus game is initiated by rolling the dice in a plurality of draw rounds to determine whether the player can achieve up to 10 winning hands. For example, as shown in FIG. 5F, a player may win a full house during the bonus game, and the winnings are awarded to the player. In this example, the winning dice may be removed, and then the dice are rolled again to replace the winning dice to determine if another winning hand may be formed. When 10 winning hands are achieved, or when no more winning hands may be won, the bonus game ends.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A method of conducting a wagering game on a gaming machine that comprises a monetary-funds accepting mechanism for accepting monetary funds to increase a player credit balance, at least one display device, at least one player input device, at least one memory device, and at least one controller, the method comprising:

receiving monetary funds from a player to increase a credit balance at the gaming machine;

receiving a wager from the credit balance from the player via the at least one player input device;

displaying a playing surface at the at least one display device, the playing surface having a plurality of gaming positions;

providing a plurality of relocatable playing pieces;

randomly selecting at least one of the relocatable playing pieces to form a playing hand;

conducting a first evaluation of the playing hand to determine whether the playing hand comprises a winning outcome;

positioning the at least one of the relocatable playing pieces forming the playing hand into the plurality of gaming positions;

designating at least one of the gaming positions as a lucky spot position;

conducting a second evaluation of the playing hand to determine whether any of the at least one of the relocatable playing pieces forming the playing hand that comprise the winning outcome are disposed on the lucky spot position;

awarding any earned prize based on the first and the second evaluation.

2. The method of claim 1, wherein the relocatable gaming pieces are dice.

3. The method of claim 2, wherein the dice comprise six-sided dice with pips.

4. The method of claim 2, wherein the dice comprise a set of non-identically indiciaed dice.

5. The method of claim 2, wherein the relocatable gaming pieces are playing cards.

6. The method of claim 1, wherein the first evaluation comprises comparing the playing hand to a first payout table based on poker outcomes.

7. The method of claim 1, wherein the earned prize is a bonus event.

8. The method of claim 7, wherein the bonus event is at least one free game.

9. The method of claim 1, wherein the earned prize provides for an increase in the value of an award based on the first evaluation.

10. The method claim 9, wherein the increase in the value of the award is a multiplication of the value of the award.

11. The method of claim 10, wherein the multiplication is based on a fixed value.

12. The method of claim 10, wherein the multiplication is based on a variable value.

13. The method of claim 12, wherein the variable value is based on a secondary determination.

14. The method of claim 13, wherein the secondary determination a random selection from a weighted table of available values.

15. The method of claim 13, wherein the secondary determination is an outcome represented by a throwing or rolling of at least one die.

16. The method of claim 13, wherein the secondary determination is represented by a secondary gaming event comprising at least one of a draw of a card, a wheel spin, a dice roll, and an opening of a prize chest.

17. The method of claim 1, wherein the gaming positions comprise a grid and the gaming positions designated as lucky spot positions define a predetermined pattern of positions on the grid.

18. The method of claim 1, wherein a first wager activates the first evaluation and a second wager activates the second evaluation.

19. The method of claim 1, wherein two or more of the gaming positions are designated as lucky spot positions, and the earned prize is awarded when any of the relocatable playing pieces forming the playing hand that comprise the winning outcome are disposed on all of the lucky spot positions.

20. The method of claim 1, wherein two or more of the gaming positions are designated as lucky spot positions, and the earned prize is awarded when any of the relocatable playing pieces forming the playing hand that comprise the winning outcome are disposed on any of the lucky spot positions.

* * * * *